US005311732A

United States Patent [19]

Friedrich

[11] Patent Number: 5,311,732

[45] Date of Patent: May 17, 1994

[54] APPARATUS FOR CLEANING RESERVE SURFACES OF RING-SPINNING SPINDLES

[75] Inventor: Daniel Friedrich, Marmoutier, France

[73] Assignee: Zinser Textilmaschinen GmbH, Ebersbach/Fils, Fed. Rep. of Germany

[21] Appl. No.: 962,142

[22] Filed: Oct. 16, 1992

[30] Foreign Application Priority Data

Oct. 16, 1991 [DE] Fed. Rep. of Germany ..... 4134217

[51] Int. Cl.[5] ..... D01H 1/38; D01H 9/16

[52] U.S. Cl. ..... 57/303; 57/300; 57/306

[58] Field of Search ..... 57/300, 303, 304, 305, 57/306, 307; 28/298; 15/312.1

[56] References Cited

U.S. PATENT DOCUMENTS

| | | | |
|---|---|---|---|
| 3,263,407 | 8/1966 | Jones | 57/306 |
| 3,312,051 | 4/1967 | Schumann et al. | 57/306 X |
| 3,426,518 | 2/1969 | Winter et al. | 57/306 |
| 3,782,094 | 1/1974 | Flower et al. | 57/306 |
| 4,094,134 | 6/1978 | Kazuo | 57/306 |
| 4,133,168 | 1/1979 | Keller et al. | 57/304 |

FOREIGN PATENT DOCUMENTS

| | | | |
|---|---|---|---|
| 0251397 | 1/1988 | European Pat. Off. . | |
| 0318435 | 5/1989 | European Pat. Off. . | |
| 2947808 | 12/1980 | Fed. Rep. of Germany . | |
| 11128 | 3/1985 | Japan | 57/303 |

*Primary Examiner*—Daniel P. Stodola
*Assistant Examiner*—William Stryjewski
*Attorney, Agent, or Firm*—Herbert Dubno; Andrew Wilford

[57] ABSTRACT

In a ring-spinning or -twisting machine a longitudinal row of upright and normally rotating spindles mounted on a common support beam each have a lower reserve surface below a sleeve normally carried on the spindle. An apparatus for clearing roving wound on the surface has a guide rail extending longitudinally along a back side of the beam adjacent the spindles, a carriage displaceable along the rail past the spindles, and a drive including a longitudinally extending drive element secured to the carriage for displacing same longitudinally along the rail past the spindles. A roving-cutting element is fixed on the carriage engageable immediately adjacent the spindles between the respective lower reserve surfaces and sleeves and a roving-clearing element is fixed on the carriage below the cutting element and engageable immediately adjacent the lower reserve surfaces of the spindles.

9 Claims, 1 Drawing Sheet

APPARATUS FOR CLEANING RESERVE SURFACES OF RING-SPINNING SPINDLES

FIELD OF THE INVENTION

The present invention relates to an apparatus for cleaning the reserve surfaces of ring-spinning or -twisting spindles. More particularly this invention concerns such an apparatus which automatically clears roving windings off such spindles.

BACKGROUND OF THE INVENTION

A standard ring-spinning or -twisting machine has a spindle bank on which a multiplicity of upright spindles are rotatable. These spindles normally carry sleeves on which respective rovings are wound up to form the desired yarn packages. The yarns or rovings run over ring guides or the like to the respective spindles.

Once a package is complete, the respective guide drops down to a level below the sleeve and winds several turns of the roving around a lower reserve region on the respective spindle. When the sleeve is subsequently doffed, the roving breaks, leaving the leading end of the incoming roving wound around the lower end of the spindle. Then a new spindle is set in place and the winding operation starts again with the thread caught on the lower reserve space being caught on the new sleeve and wound up, repeating the cycle.

Clearly a problem with this system is that the reserve surface quickly gets fouled with the roving, since several turns are added each time the sleeve is changed. These reserve surfaces must be cleared periodically.

Accordingly a machine has been proposed in European patent application 251,397 filed based on an Italian priority of 29 June 1988 by S. Sartoni et al that has a carriage that moves past the spindles and that carries equipment for clearing the reserve surfaces. This equipment includes a motorized scraper and a vacuum arrangement. In general such a system is quite complex and adds considerably to the cost of the apparatus.

Other similar devices are described in Swiss patent 432,319 assigned to Deutscher Spinnereimaschinenbau Ingolstadt, European patent application 219,129 assigned to Murao Boki KK, and German 1,760,775 and French 2,432,566 both of Zinser Textilmaschinen GmbH.

OBJECTS OF THE INVENTION

It is therefore an object of the present invention to provide an improved system for clearing the reserve surfaces of spindles of a ring-spinning or -twisting machine.

Another object is the provision of such an improved system for clearing the reserve surfaces of spindles of a ring-spinning or -twisting machine which overcomes the above-given disadvantages, that is which is relatively simple, which operates automatically and surely, and that perfectly clears the reserve surfaces.

SUMMARY OF THE INVENTION

In a ring-spinning or -twisting machine a longitudinal row of upright and normally rotating spindles mounted on a common support beam each have a lower reserve surface below a sleeve normally carried on the spindle. According to the invention an apparatus for clearing roving wound on the surface has a guide rail extending longitudinally along a back side of the beam adjacent the spindles, a carriage displaceable along the rail past the spindles, and a drive including a longitudinally extending drive element secured to the carriage for displacing same longitudinally along the rail past the spindles. A roving-cutting element is fixed on the carriage engageable immediately adjacent the spindles between the respective lower reserve surfaces and sleeves and a leaf-spring roving-clearing element is fixed on the carriage below the cutting element and engageable immediately adjacent the lower reserve surfaces of the spindles.

Thus with this system the carriage is swept past a spindle with the cutting element first severing the roving between the reserve surface and the new sleeve, and then the clearing element stripping the roving off the reserve surface. Once the roving is cut between the reserve surface and the sleeve, it is normally a simple matter of unwinding the roving, something that is assisted by the rotation of the spindles.

According to another feature of the invention a toothed tearing element is provided on the slide vertically generally between the reserve surfaces and spindles. This tearing element has teeth inclined to the beam, normally inclined into the forward longitudinal direction of displacement of the carriage as it makes its first sweep past the twisting stations.

The cutting element also has teeth that are similarly angled to the beam, that is to the longitudinal direction defined by the beam.

In order to accommodate different systems the elements are adjustable mounted on the slide for displacement transversely of the beam. In addition the elements are spaced apart longitudinally on the carriage.

BRIEF DESCRIPTION OF THE DRAWING

The above and other objects, features, and advantages will become more readily apparent from the following, reference being made to the accompanying drawing in which.

SPECIFIC DESCRIPTION

Figure 1:
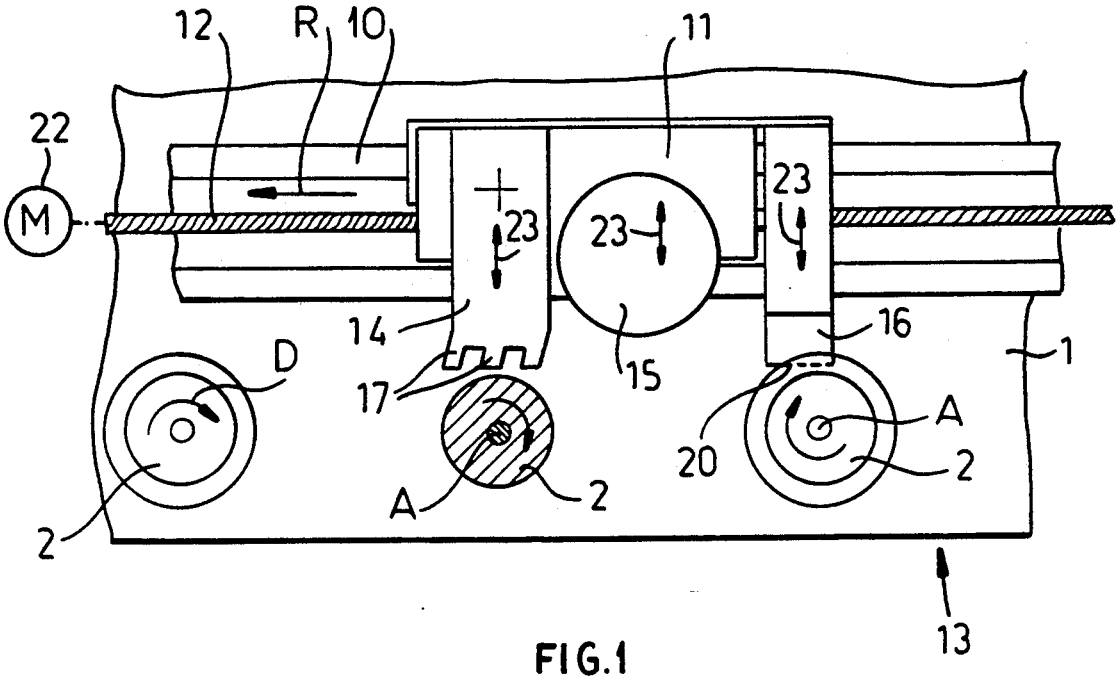
FIG. 1 is a partly diagrammatic top view of the system of this invention.
Figure 2:
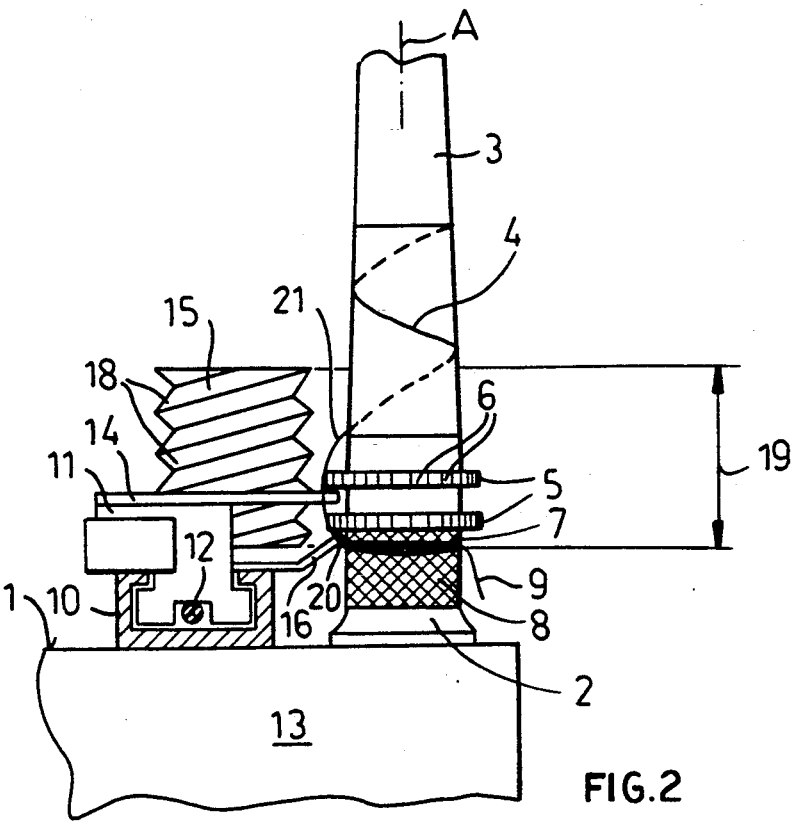
FIG. 2 is a sectional end view of the system.

A spindle beam 13 of a ring-spinning or -twisting machine has an upper surface 1 on which a row of spindles 2 are rotatable about respective vertical axes A. The spindles 2 each carry a sleeve 3 on which a respective body 4 of roving is wound. Beneath each sleeve 3 each spindle 2 carries two axially spaced disks 5 having filament-catching notches 6. Each spindle 2 further is formed underneath the respective disks 5 with a knurled reserve surface 8.

As is standard, before a full sleeve 3 is doffed and the rotation of the respective spindle 2 is stopped, the unillustrated roving guide drops down level with the reserve surface 8 so that a plurality of turns 7 of roving are wound about it. Thus when the sleeve 3 with its finished yarn package 4 is subsequently doffed, the roving will break, leaving a trailing end 9, while the roving will extend at 21 back through the unillustrated guide to the supply. A new sleeve 3 is fitted to the empty spindle 2 after doffing the filled one, the new spindle 2 is rotated and the unillustrated guide is raised so that the filament end 21 is first caught in the notches 6 of the disks 5 and then is wound as a new package 4 around the new sleeve 3.

In accordance with the invention a guide rail 10 extends along the back of the row of spindles 2, that is that side turned away from the outside of the machine where operators can move. This rail 10 slidably supports a carriage 11 that-can be pulled longitudinally along it in a forward direction R by a cable 12 connected to a schematically illustrated motor 22. The slide carriage 11 carries, spaced apart in the direction R, a roving cutter 14, a loop opener 15, and a surface cleaner 16.

The roving cutter 14 extends into the path of the roving between the reserve surface 8 and the winding 4 on the sleeve 3. In the illustrated embodiment with two disks 5 it projects into the region between the two disks 5 traversed by the filament end 21. The cutter 14 has forward-angled sawtooth-shaped projections 17.

The fixed loop opener 15 has tearing elements 18 shaped like milling disks and extending from the upper region of the reserve surface 8 to the lower region of the yarn package 4. It serves to catch and tear any loops or ends of roving that project out from the spindle 2 it is adjacent.

The surface cleaner 16 is a leaf spring that has a front edge 20 projecting closely into the region between the surface 8 and the lower disk 5, without however contacting the knurled surface 8.

Once as described above a sleeve has been doffed and a new sleeve donned, with the filament extending at 21 from the currently forming package 4 down to the turns 7 wound on the surface 8, the motor 22 moves the slide 11 in direction R longitudinally slowly past all the spindles 2. First the cutter 14 engages with its teeth 17 into the filament end 21 extending from the surface 8 to the package 4 and breaks this roving. The loose end and any loops engage in the toothed elements 18 of the device 15 and strip them off.

In this manner the windings 7 are freed at both ends and normally the rotation of the spindle 2 is sufficient to unwind them. Since the spindles 2 rotate in direction D, normally the windings 7 will unwind starting from the cut end 21.

When however this unwinding does not take place, because for instance the turns overlap, the cleaner 16 engages into them and rubs, tears, or unwinds them completely, stripping off the winding 7 fully.

This sequence of steps takes place sequentially at each spindle as the carriage 11 moves slowly past it. If for some reason some windings are left on a reserve surface 8 of a spindle 2, the carriage 11 can be moved by it again. Before the sleeves 3 are doffed there is plenty of time to repeat the cycle several times and ensure that the surfaces 8 are all perfectly clear.

Since loops are much less likely to form in the roving torn off by the cutter 14 in short-staple fiber, like cotton, the element 15 can be dispensed with. With long-staple fibers, like wool, it is essential.

Arrows 23 indicate how the lateral or transverse positions of the elements 14, 15, and 16 can be adjusted on the carriage 11 to accommodate spindles of different dimensions.

I claim:

1. In combination with a ring-spinning or twisting machine having:

a common support beam and a longitudinal row of upright and normally rotating spindles mounted on the common support beam and each having a lower reserve surface below a sleeve carried on the spindle and upper and lower axially spaced disks forming a radially outwardly open gap, an apparatus for clearing roving wound on the surface, the apparatus comprising:

a guide rail extending longitudinally along a back side of the beam adjacent the spindles;

a carriage displaceable along the rail past the spindles;

drive means including a longitudinally extending drive element secured to the carriage for displacing same longitudinally along the rail past the spindles;

a roving-cutting element fixed on the carriage engageable into the gap between the disks; and a roving-clearing element on the carriage below the cutting element and engageable immediately underneath the disks of the spindles.

2. The roving-clearing apparatus defined in claim 1, further comprising a toothed tearing element on the carriage vertically generally aligned between the reserve surfaces and spindles and horizontally between the cutting element and the clearing element.

3. The roving-clearing apparatus defined in claim 2 wherein the tearing element has teeth inclined to the beam.

4. The roving-clearing apparatus defined in claim 1 wherein the cutting element has teeth.

5. The roving-clearing apparatus defined in claim 4 wherein the teeth of the cutting element extend at an acute angle to the beam.

6. The roving-clearing apparatus defined in claim 5 wherein the carriage is displaced longitudinally in one direction past the spindles and the cutting-element teeth extend forward into this direction.

7. The roving-clearing apparatus defined in claim 1 wherein the elements are adjustable mounted on the carriage for displacement transversely of the beam.

8. The roving-clearing apparatus defined in claim 1 wherein the elements are spaced apart longitudinally on the carriage.

9. The roving-clearing apparatus defined in claim 1, wherein the disks have toothed outer peripheries.

* * * * *